United States Patent [19]

Koresh

[11] Patent Number: 4,611,760

[45] Date of Patent: Sep. 16, 1986

[54] ROTARY IRRIGATION SPRAY DEVICE

[75] Inventor: Peretz Koresh, Galil Elyon, Israel

[73] Assignee: Dan Mamtirim, Galil Elyon, Israel

[21] Appl. No.: 654,146

[22] Filed: Sep. 25, 1984

[30] Foreign Application Priority Data

Oct. 3, 1983 [IL] Israel ..... 69887

[51] Int. Cl.[4] ..... B05B 3/14

[52] U.S. Cl. ..... 239/233

[58] Field of Search ..... 239/225, 227, 230–233, 239/237, 263, 515, DIG. 1

[56] References Cited

U.S. PATENT DOCUMENTS 1,491,253 4/1924 Barnes ..... 239/231
1,733,754 10/1929 Reddemann ..... 239/515
3,350,015 10/1967 Friedmann et al. ..... 239/230
3,664,586 5/1972 Harris ..... 239/233

*Primary Examiner*—Andres Kashnikow
*Attorney, Agent, or Firm*—Browdy and Neimark

[57] ABSTRACT

A rotary irrigation spray device comprises a support adapted to be fixedly mounted on an irrigation riser; a spray shroud member pivotally mounted on the support; a deflector member pivotally mounted within the shroud member and pivotally displaceable within the shroud member between a pair of positions so as to define therewith an alternate pair of spray outlet paths and guide members for determining the angle of rotational displacement of the shroud member and for successively displacing the deflector member into one or other of its positions.

4 Claims, 6 Drawing Figures

ROTARY IRRIGATION SPRAY DEVICE

This invention relates to a rotary irrigation spray device.

According to the present invention there is provided a rotary irrigation spray device comprising a support adapted to be fixedly mounted on an irrigation riser; a spray shroud member pivotally mounted on said support, a deflector member pivotally mounted within said shroud member and pivotally displaceable within said shroud member between a pair of positions so as to define therewith an alternate pair of spray outlet paths and guide means for determining the angle of rotational displacement of said shroud member and for successively displacing said deflector member into one or other of its positions.

With such a rotary spray device in accordance with the present invention it is possible, simply and economically to spray an area whose location vis-a-vis the device and whose absolute area can be predetermined and varied at choice.

One embodiment of a rotary irrigation spray device in accordance with the present invention will now be described by way of example and with reference to the accompanying drawings, in which.

Figure 3B:
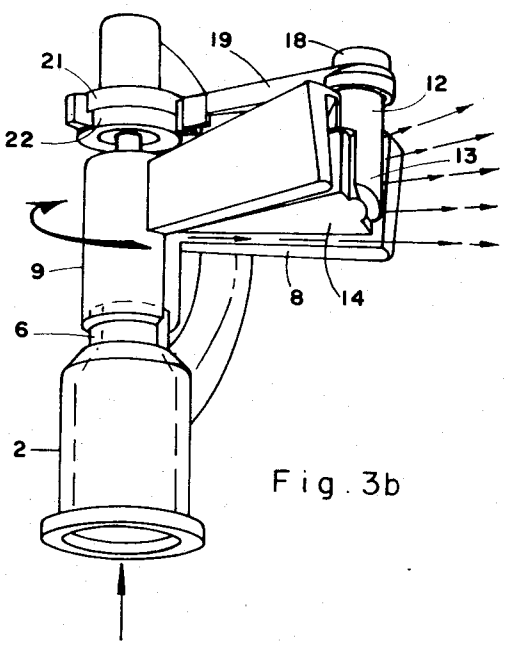
Figure 3A:
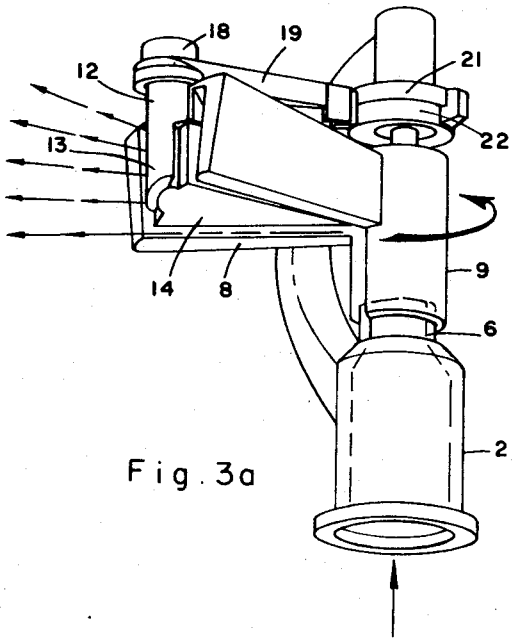
Figure 4A:
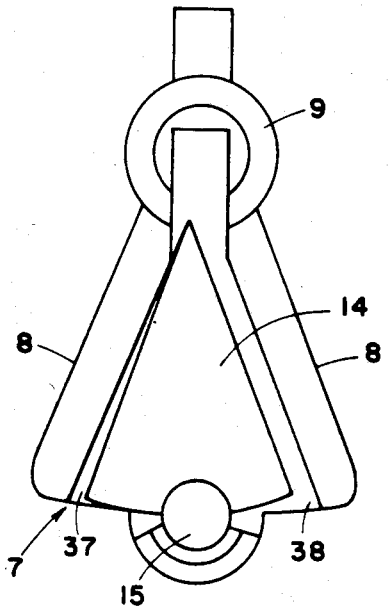
Figure 4B:
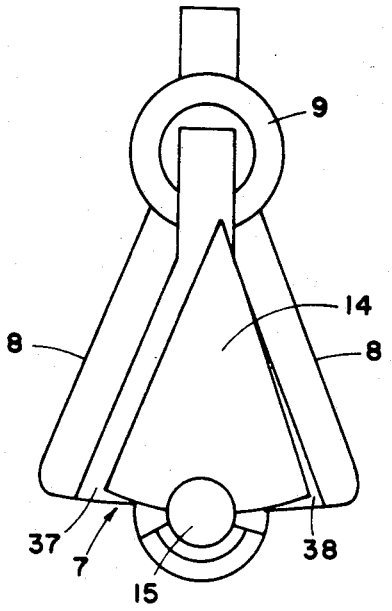

FIGS. 3*a* and 3*b* are respective perspective views of the device showing the rotation thereof in respectively opposite senses; and FIGS. 4*a* and 4*b* are schematic views through a component of the device showing the displacement thereof so as to allow for respective rotation in opposite senses.

Figure 1:
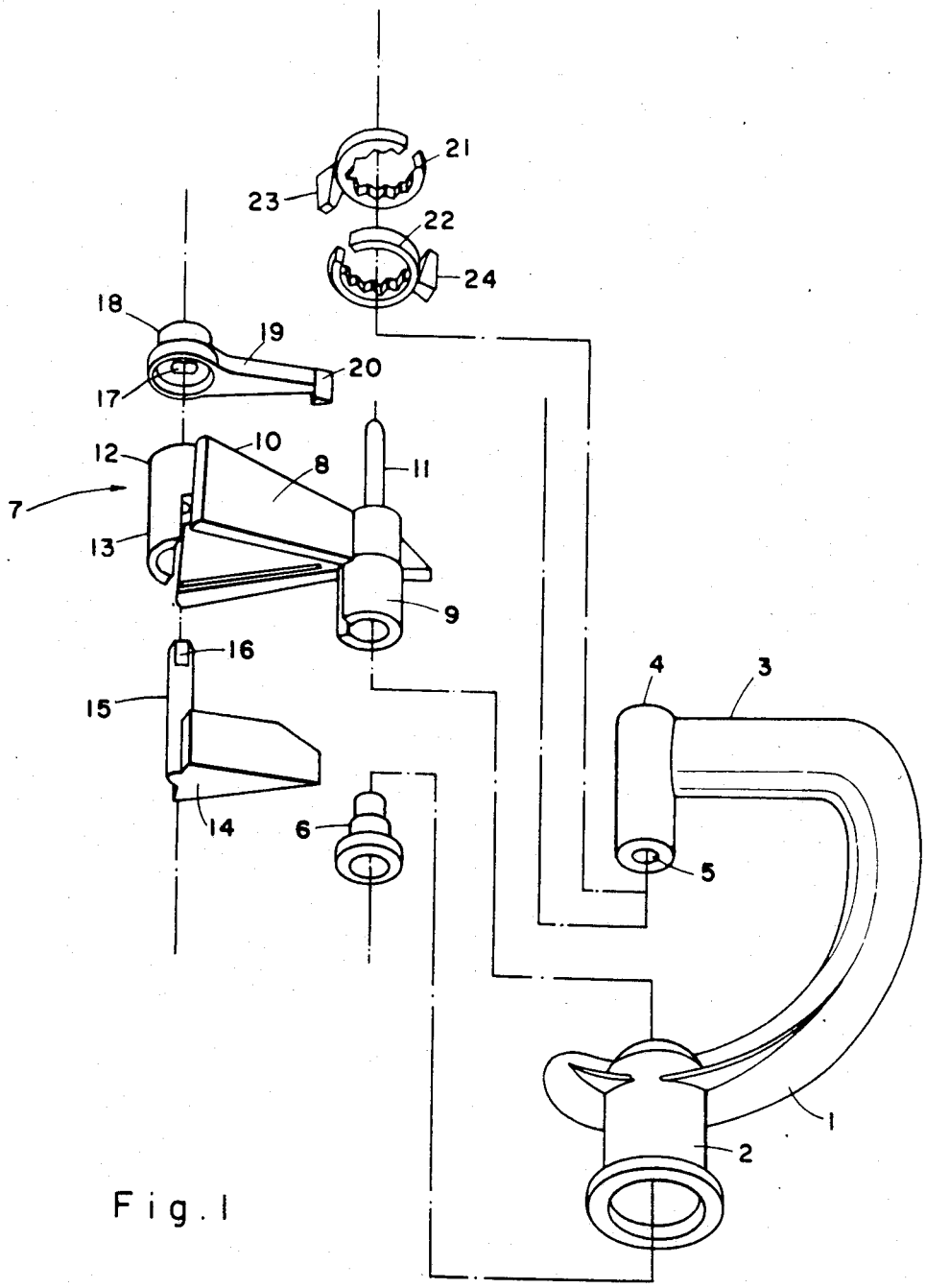
FIG. 1 is an exploded perspective view of the device.

As seen in FIG. 1 of the drawings, the device comprises a curved support arm 1, one end of which is formed integrally with an apertured coupling cup 2 and the other end of which is formed integrally with a substantially horizontal support limb 3 formed at its free end with a coupling hub 4 having a bore 5. Frictionally fitted within the coupling cup 2 is a bored coupling member 6, one bearing end of which extends beyond the cup 2 towards the hub 4. Thus, the coupling cup 2 and the bored coupling member 6 constitute irrigation coupling means for fixed mounting on an irrigation riser to which coupling means the arm 1 and limb 3 are fixedly secured.

A rotatable shroud member 7 is formed with a pair of transversely directed walls 8 which radiate from a central hollow split hub 9 and which define between them an acute angle. The walls 8 are bridged at their upper edges by a bridging wall 10. A pivoting pin 11 projects upwardly out of the hub 9 so as to be coaxial therewith. Formed integrally with the free edge of the bridging wall 10 is a bored hub 12 formed integrally with a downwardly extending semicylindrical skirt 13. The hub 9 constitutes a spray discharge member and the axial split in the wall thereof constitutes a discharge outlet.

A central member 14 of substantially triangular cross-sectional shape fits into the shroud member 7, being formed at its broader end with an integral pivot rod 15 whose uppermost end 16 thereof is of substantially rectangular cross-sectional shape. The rod 15 extends through the central bore of the bored hub 12 into a corresponding rectangular aperture 17 formed in a receiving hub 18 formed integrally with one end of an arm 19 (constituting deflecting means), the other end 20 of which constitutes an abutment end.

A pair of split abutment collars 21 and 22 respectively formed with integral abutment projections 23 and 24 fit superimposedly around the lowermost portion of the coupling hub 4, the outer surface of which is axially serrated so as to mate with corresponding serrations formed in the split collars 21 and 22.

Figure 2:
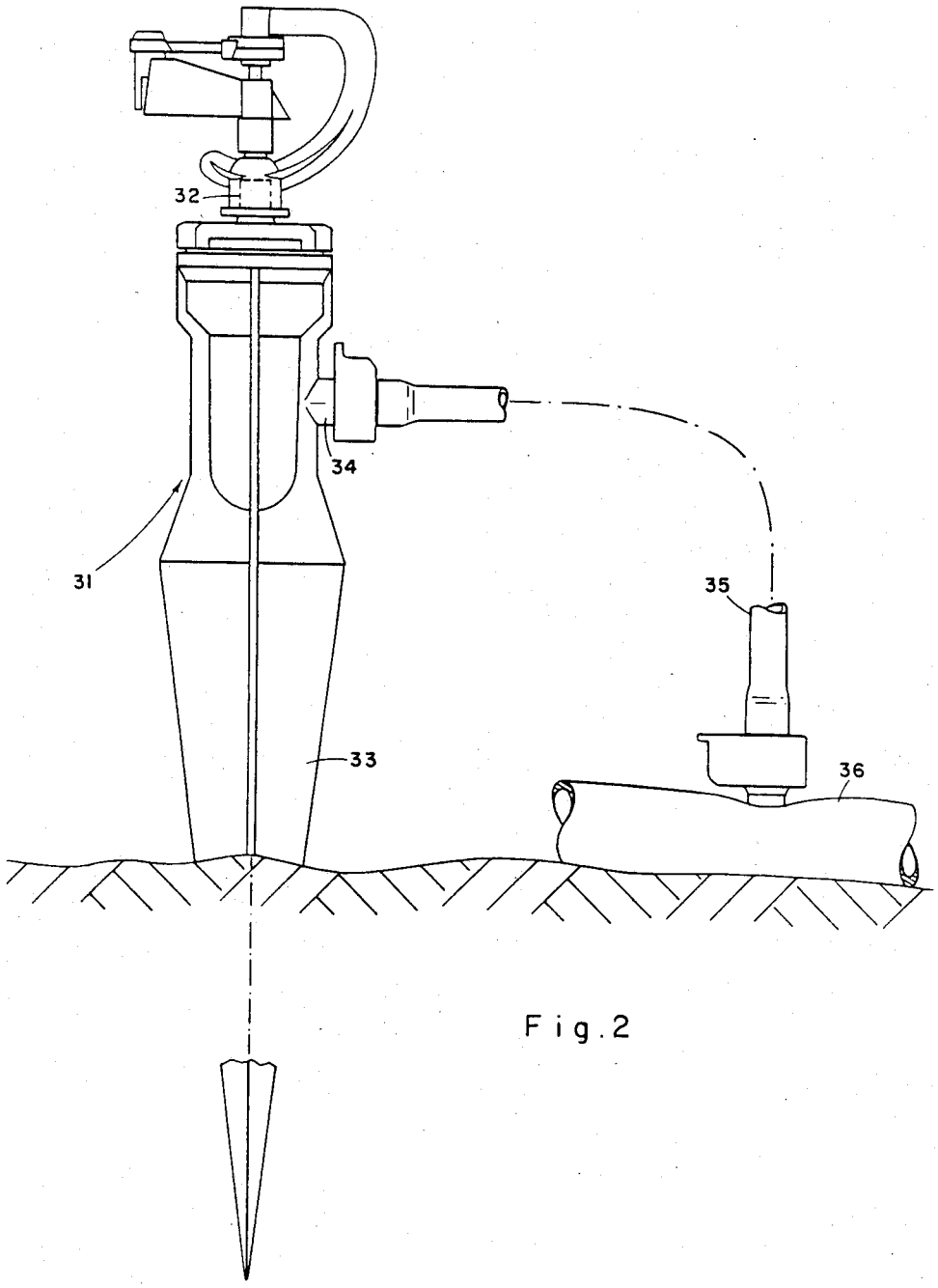
FIG. 2 illustrates the mounting of the device on a riser and the coupling of the latter to an irrigation pipe.

With the spray device component assembled as just described the device is mounted on an irrigation riser 31 as shown in FIG. 2 of the drawings, an outlet end 32 of the riser frictionally fitting into the coupling cup 2, the riser itself being mounted in the ground by means of a spike 33 and being coupled by means of a coupling nipple 34 and a coupling conduit 35 to an irrigation pipe 36.

As can be seen, the support arm 1, support limb 3, coupling cup 2, and coupling hub 4 are fixedly mounted with respect to the riser 31. On the other hand, the shroud member 7 is pivotally rotatable with respect to the riser within limits determined by the relative angular positions of the projections 23 and 24. Thus, the shroud member 7 is articulated to the arm 19 and the respective abutting of the other end 20 of the guide arm 19 with the projections 23 and 24 determines the limits of rotation of the shroud member 7.

At the same time however, the central member 14 is pivotally displaceable with respect to the shroud member 7 about a pivotal axis which coincides with the line of contact of the pivot rod 15 and the internal surface of the skirt 13. The two extreme pivotal positions of the central member 14 with respect to the shroud member can be seen in FIG. 4 of the drawings from which it will be noted that, in these extreme pivotal positions, the central member 14 defines with the respective walls 8 of the shroud member 7 two respective outlet paths 37 and 38 which are eccentrically directed with respect to the axially directed flow from the riser.

It will be readily seen that the abutting of the other end 20 of the guide arm 19 with one or other of the projections 23 and 24 pivotally displaces the central member 14 into one or other of its pivotal positions whereby one or other of its outlet paths 37 and 38 is freed for the outflow of the irrigation spray.

In operation therefore and with the flow of irrigation water from the riser 31 through the coupling cup 2, coupling member 6 and split hub 9 into the shroud member 7, the water flows out of one of the available irrigation outlet paths 37 and 38 and, in so doing by virtue of the eccentric direction of these paths, exerts a turning couple on the shroud member 7, causing the latter together with the guide arm 19 to rotate in a first sense, this rotation continuing until the end 20 abuts one of the projections 23, 24. When this happens the deflecting member 14 pivots so as to seal off the previously free outlet path and to open the second path whereupon the outflowing water flows through this second path, exerting a turning couple on the shroud member 7 in a sense opposite to that exerted in the first instance and the shroud member now rotates in the opposite sense until the end 20 abuts the other of the projections whereupon the procedure just described is reversed.

In this way the spray device is effective is spraying an area of substantially sector-like shape whose angle is essentially determined by the angular separation of the projections 23 and 24. Thus, the greater the angular separation of the projections 23 and 24, the greater will be the area sprayed. Furthermore, by adjusting the relative absolute position of the projections 23 and 24, the absolute location of the area to be sprayed can be predetermined. By virtue of the fact that the split collars 21 and 22 mate with the hub 4 by means of axially serrated surfaces, the relative disposition of the collars can be readily indexed.

The irrigation spray device as just described in accordance with the present invention effectively and simply allows for the spraying of areas of differing sizes and locations.

I claim:

1. A rotary irrigation spray device comprising irrigation coupling means for fixed mounting on an irrigation riser;

a spray discharge member rotatably mounted with respect to said coupling means so as to receive an upward, axially directed irrigation flow from said riser;

a wall portion of said spray discharge member having defined therein a substantially axially directed discharge outlet for a transversely directed discharge of said spray;

a pair of transversely directed walls extending integrally from said discharge member on either side of said discharge outlet;

a central member, located between said walls and substantially coextensive therewith and pivotally mounted, at an end thereof remote from said discharge outlet with respect to said transversely directed walls so as to be pivotally displaceable between said walls between a pair of positions so as to define with said walls a pair of angularly directed spray outlet paths which alternatingly communicate with said discharge outlet and which are eccentrically directed with respect to said axially directed flow;

a deflecting means coupled to said central member so as to be pivotally displaceable therewith between a pair of angularly spaced apart abutments fixedly mounted with respect to said coupling means, the arrangement being such that successive contact of said deflecting means with said abutments causes the successive displacement of said central member into one or other of its positions.

2. A spray device according to claim 1 wherein said transversely directed walls define between them an acute angle which opens outwardly from said discharge member and wherein said central member is of a substantially wedge shape and is pivotally mounted at its broad end with respect to said coupling means.

3. A spray device according to claim 2 wherein said deflecting means comprises an arm coupled at one end to said central member whose opposite end is disposed adjacent said abutments.

4. A spray device according to claim 3 wherein said abutments are respectively formed on a pair of coaxial collars mounted on said coupling means which collars are capable of relative rotation with respect to each other so as to vary the angular separation of said abutments.

* * * * *